US006799397B2

(12) United States Patent
Helmy

(10) Patent No.: US 6,799,397 B2
(45) Date of Patent: Oct. 5, 2004

(54) PREFABRICATED NICHE KIT AND METHOD OF INSTALLATION

(76) Inventor: Ibrahim F. Helmy, 7334 Caribou St., San Antonio, TX (US) 78238-1230

( * ) Notice: Subject to any disclaimer, the term of this patent is extended or adjusted under 35 U.S.C. 154(b) by 0 days.

(21) Appl. No.: 10/079,256

(22) Filed: Feb. 20, 2002

(65) Prior Publication Data

US 2002/0134031 A1 Sep. 26, 2002

Related U.S. Application Data

(63) Continuation-in-part of application No. 09/663,860, filed on Sep. 15, 2000, now abandoned.

(51) Int. Cl.[7] ..... E04F 19/00
(52) U.S. Cl. ..... 52/27; 52/36.4; 52/36.1
(58) Field of Search ..... 52/102, 36.4, 27, 52/311.1, 306, 307, 308, 36.1; 211/134; 312/242, 114; 144/144.1, 144.51

(56) References Cited

U.S. PATENT DOCUMENTS 1,578,305 A * 3/1926 White ..... 52/36.4
1,850,292 A * 3/1932 Skelly ..... 220/477
2,070,641 A * 2/1937 Bartels ..... 312/224
3,620,404 A * 11/1971 Grasso ..... 220/477
3,925,944 A * 12/1975 Pickel ..... 52/134
4,336,673 A * 6/1982 Duchesne et al. ..... 52/27
4,681,380 A * 7/1987 Carlin ..... 312/242
6,338,225 B1 * 1/2002 Hayes ..... 52/27

* cited by examiner

*Primary Examiner*—Jeanette Chapman
(74) *Attorney, Agent, or Firm*—David G. Henry

(57) ABSTRACT

The invention is of a prefabricated niche kit and associated methods for installation and fireproofing/strengthening thereof. The kit includes a molded plastic niche and a template to facilitate marking the boundary of wall material to be cut away for forming a cavity into which the molded plastic niche will be placed in a wall. The niche may be molded to include any number of decorative features, and includes an outer flange which overlies and hides the boundaries of the cavity after a cutting operation. Once a cavity is formed in a wall, the prefabricated niche is simply slid into place, and secured using caulking or suitable adhesive.

2 Claims, 2 Drawing Sheets

PREFABRICATED NICHE KIT AND METHOD OF INSTALLATION

This application is a continuation-in-part of application Ser. No. 09/663,860 filed on Sep. 15, 2000.

BACKGROUND OF THE INVENTION

1. Field of the Invention

The present invention relates to building materials and architectural accents.

2. Background Information

A niche (a decorative recess in a wall surface) is a feature found in luxury homes and in some commercial building environments. That niches are limited to the upscale market in homes and office buildings is a result of the expense of constructing them.

Conventionally, a niche is formed by building a framework of wood (and sometimes plaster mesh) which framework is attached to, and supported by the wall studs. After the rough structure is formed, the visible, exterior surfaces are finished out with dry wall, plaster, wallpaper, or a combination thereof. A decorative trim is often formed to outline the niche.

Quite obviously, conventional construction of niches is costly and time-consuming. Furthermore, when multiple, identical niches are to be constructed (on either side of a foyer, for example) it is difficult to perfectly match the niches as would be desired in such a situation.

In addition, commercial building codes may require fireproofing of architectural accents. Conventional methods of applying fireproofing and strengthening materials entail the use of wire mesh fitted around the accent to form a strata upon which the material will adhere. This method is time-consuming and labor intensive. A simpler method would reduce costs while still providing the much needed fireproofing quality.

To date, the present inventor is unaware of any prefabrication of niches, or other cost or time saving[] methods or materials to bring down the cost of having niches in homes and offices.

It would well serve the home and office construction industry, as well as, ultimately, those who inhabit homes and offices to provide a means by which such attractive, aesthetically pleasing, and safe, architectural features as niches may be incorporated at a lower cost and thereby made available to the broader population.

SUMMARY OF THE INVENTION

It is an object of the present invention to provide a prefabricated niche kit for use in easily installing a niche in walls of homes and offices.

It is another object of the present invention to provide a prefabricated niche kit and associated method for installation thereof which, in combination, affords substantial time and money savings as compared to conventional niche construction materials and methods.

It is another object of the present invention to provide a method for creating a niche in a wall of a home or commercial building.

It is another object of the present invention to provide a method of applying fireproofing and/or strengthening material to prefabricated niches in a manner which would be easily accomplished in order to save time and money.

In satisfaction of these and related objectives, the present invention provides a prefabricated niche kit and associated method for installation thereof, which apparatus and method affords dramatic cost and time savings for builders, do-it-yourselfers, and end users, when compared with conventional niche construction materials and methods.

The preferred embodiment of the prefabricated niche is constructed of molded, paintable plastic. Using a template provided as part of the intended packaging, and installer of the present niche merely forms a cavity in an existing wall or dry wall substrate, sets the prefabricated niche into the cavity, and, using a caulking gun, seals the prefabricated niche into position. The niche may then be painted or plastered over.

The apparatus and method of the present invention enables full completion of a niche in a matter of minutes (excepting only painting or plastering), and is something easily achieved by those wholly inexperienced in construction or remodeling.

DETAILED DESCRIPTION OF THE PREFERRED EMBODIMENT

Figure 1:
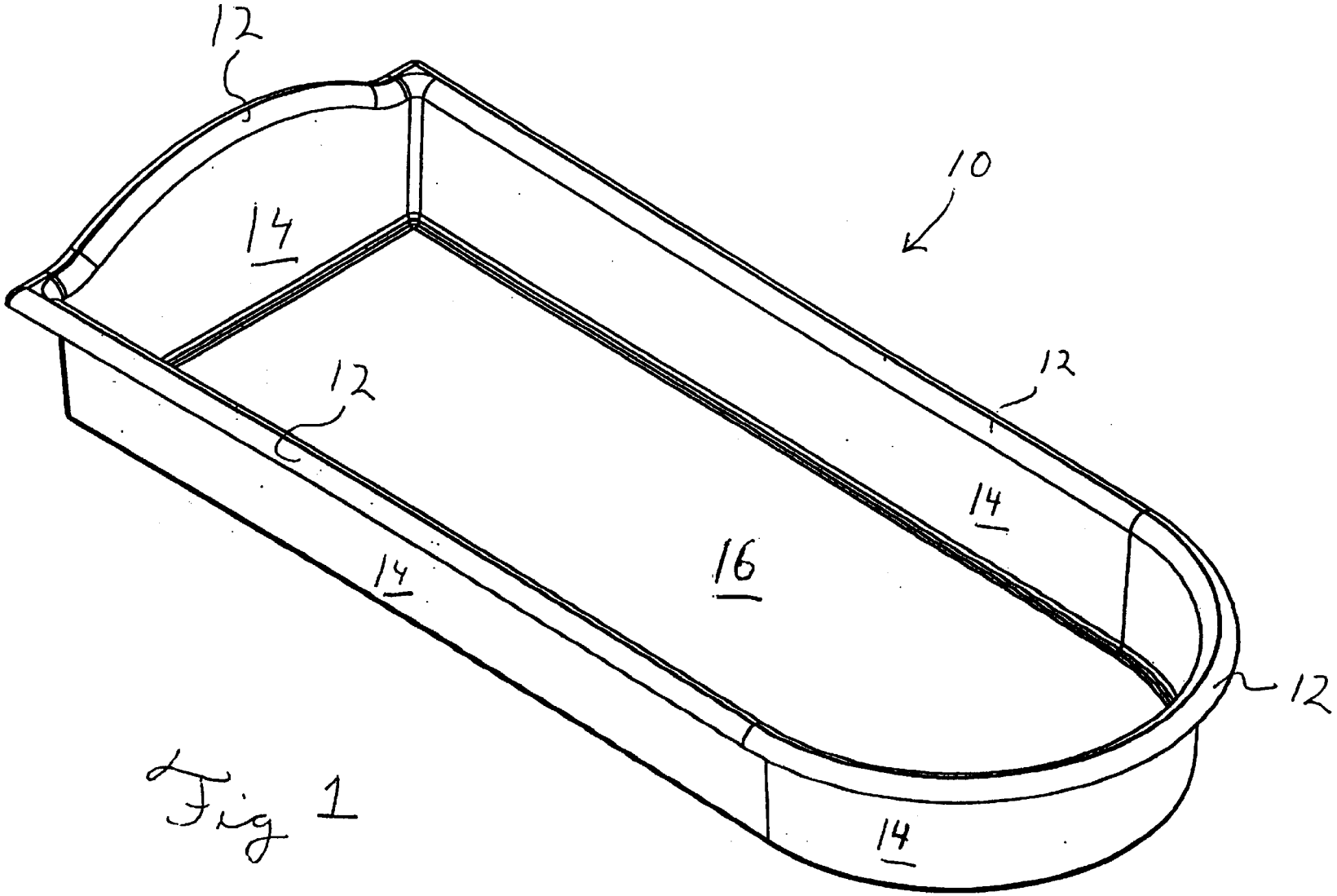
FIG. 1 is a perspective view of a prefabricated niche of the preferred embodiment.

Referring to FIG. 1, the prefabricated niche of the present invention is identified generally by the reference numeral 10. Niche 10 is formed from molded, paintable plastic. While injection molding might be the first manufacturing process to occur to most who worked with such preformed plastic articles, and would work quite well, vacuum molding is preferable for purposes of initial setup costs (vacuum form molds are substantially less expensive than injection molding molds) and actual production costs.

Figure 2:
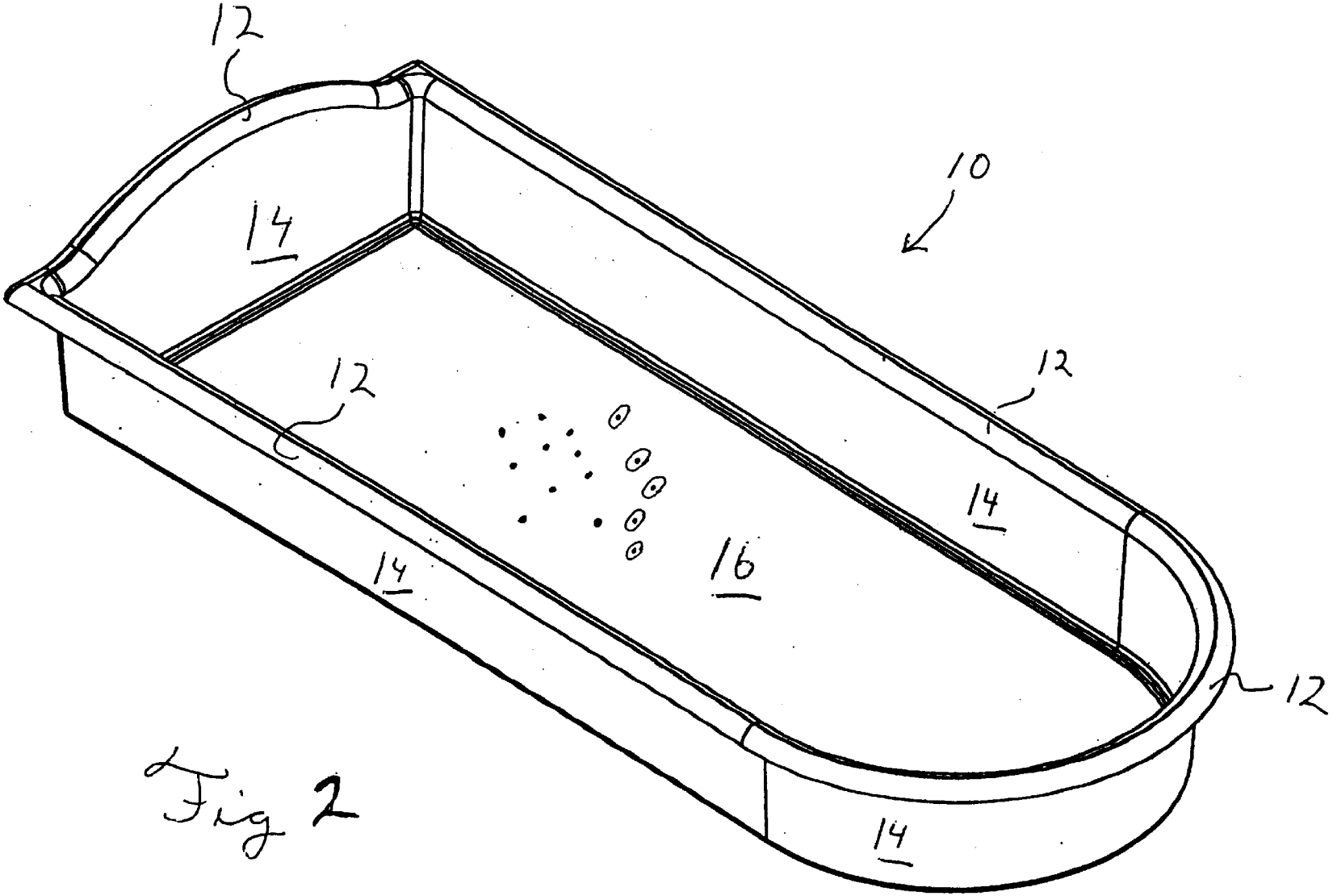
FIG. 2 is a perspective view of a prefabricated niche of the preferred embodiment demonstrating gypsum plaster application.

Referring to FIG. 2, the prefabricated niche of the present invention can be strengthened and fireproofed by using a technique that will result in savings of time and money over conventional methods. Holes +/−⅛−2" o.c. are drilled into the niche using high speed punching techniques. Disks of 3⁄16" thickness are then adhered onto the niche surface in order to guide plaster application. Gypsum plaster can easily be applied over the holes and disks in a uniform coating of approximately ¼" thickness. This results in a strengthened prefabricated niche that is capable of satisfying building codes and being installed in many commercial buildings.

Niche 10 can easily be formed to have any desired "footprint" in a wall. Unlike niches constructed according to conventional methods and with conventional materials, the plastic molding can easily be modified to produce contours of any desired shape without the slightest complications being caused at the installation stage.

A decorative flange 12 frames the outer margin of niche 10 and replaces the custom fabricated framework as would ordinarily be provided around a niche of conventional construction. This too represents a substantial time and materials cost savings, and, in fact, eliminates one installation step altogether.

Because niche 10 is to be telescopically received within a cavity to be formed in an existing wall, the easiest installation is one which involves a niche which has side walls 14 which are orthogonal to rear wall 16 (at all points intersect at 90° angles), else the niche 10 will not fully fit into the cavity which is formed in the wall, or it will be loose when it is fully inserted. Of course, alternative embodiments which involve niche members which are rounded, or shell-shaped are desirable in many situations. Such a case, however, simply requires that the entire support of the niche be by the flange 12, not relying on support inside the cavity in which the niche will be installed.

Although not shown in the drawings, the intended packaging of the present niche facilitates a portion of the installation methodology. At least one portion of the envisioned packaging will include a flat, cardboard section with the outline of a suitable template printed thereon. In the alternative, a pre-cut template may be provided.

To use the template, a user merely cuts the template from the cardboard sheet (if a pre-cut version is not provided), cutting along the printed lines. Thereafter, the user temporarily attaches the template in the position where the niche is to be installed on a wall, and traces around the template with the marker of some kind. Depending on the type of wall material (dry wall, etc.), the suitable cutting implement is used to remove wall material corresponding to the footprint for the niche as determined by the template.

Only in the event that the niche is to be positioned such that a wall stud spans the cavity space for the niche will any structural alterations necessarily be made to the building itself, once the surface wall material has been cut away.

Once the cavity for the niche has been formed, the installer merely slides the prefabricated niche 10 into the cavity and, using a caulking gun with suitable sealant (latex caulk, for example), secures niche 10 into position with a smooth, aesthetically acceptable bead adjacent to the outer most margin of flange 12.

If stainable or paintable plastic material is used to form niche 10, as is intended in the preferred embodiment thereof, one thereafter paints or stains niche 10 as esthetic preferences dictate. In the alternative, decorative, textured plastics may be used which do not require any further surface treatment.

Alternative embodiments to the niche 10 shown in FIG. 1 include ones with additional architectural features formed therein. Shelves, for example, may be wholly formed as molded components of niche 10, or shelf supports may be molded into side walls 14 to support later-added shelving. Features for supporting or constituting lighting fixtures or fountains may also be included as prefabricated elements for niche 10. Alternatively, a mirror may be added to niche 10 and various trims may easily be used to alter the look and even the shape of the niche itself. In short, the features to be included in a prefabricated niche 10 are limited only by the capacity for plastics molding professionals to create and use the appropriate molds and trims.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An prefabricated niche kit comprising:

a niche member having an interior and exterior surface, respectively defining a recess and a protruding surface, said niche member having a margin which lies substantially in a single plane, said niche member being fabricated from pre-formed plastic;

said niche member further having a flange attached to said margin and extending outward from said margin;

a portion of said niche member being perforated with a plurality of cavities in a non-protruding surface and said cavities engaging with plaster material;

a template member which the delimits a space room corresponding in size and shape to said outer margin of said niche member.

2. A method for installing a wall niche comprising the steps of:

selecting a prefabricated, plastic niche kit, said niche kit comprising:

a niche member having an interior and exterior surface, respectively defining a recess and a protruding surface, said niche member having a margin which lies substantially in a single plane, said niche member being fabricated from pre-formed plastic;

said niche member further having a flange attached to said margin and extending outward from said margin;

a portion of said niche member being perforated with a plurality of cavities in a non-protruding surface and said cavities engaging with plaster material;

a template member which the delimits a space room corresponding in size and shape to said margin of said niche member;

temporarily affixing said template to a wall surface into which a user desires to install said niche;

tracing around said template to delimit the portion of wall material to be removed for creating a cavity into which said niche member will be inserted;

cutting said wall material along marks drawn during said tracing and removing wall material within the bounds of said marks to form said cavity;

sliding said prefabricated niche into said cavity, juxtaposing said flange to said wall material surrounding said cavity; and securing said niche into said cavity.

* * * * *